US006250661B1

(12) United States Patent
Dickie et al.

(10) Patent No.: US 6,250,661 B1
(45) Date of Patent: Jun. 26, 2001

(54) TILT SYSTEM FOR A POWERED WHEELCHAIR SEAT

(75) Inventors: Paul C. Dickie, Clovis, CA (US); James M. Koerlin, Broomsfield, CO (US)

(73) Assignee: Sunrise Medical HHG Inc., Longmont, CO (US)

( * ) Notice: Subject to any disclaimer, the term of this patent is extended or adjusted under 35 U.S.C. 154(b) by 0 days.

(21) Appl. No.: 09/191,295

(22) Filed: Nov. 13, 1998

(51) Int. Cl.[7] ..... A47C 1/02
(52) U.S. Cl. ..... 280/304.1; 297/329
(58) Field of Search ..... 280/250.1, 304.1, 280/647, 648, 650; 180/907; 297/329

(56) References Cited

U.S. PATENT DOCUMENTS

| | | | | |
|---|---|---|---|---|
| 3,952,822 | | 4/1976 | Udden et al. | 180/21 |
| 4,310,167 | * | 1/1982 | McLaurin | 280/5.28 |
| 4,333,681 | * | 6/1982 | Nelson | 297/83 |
| 4,834,411 | * | 5/1989 | Willey et al. | 280/250.1 |
| 4,966,379 | | 10/1990 | Mulholland | 280/242.1 |
| 5,020,816 | | 6/1991 | Mulholland | 280/250.1 |
| 5,050,899 | | 9/1991 | Stensby | 280/250.1 |
| 5,297,021 | | 3/1994 | Koerlin et al. | 364/167.01 |
| 5,575,348 | * | 11/1996 | Goertzen et al. | 180/65.6 |
| 5,971,482 | * | 10/1999 | Goertzen et al. | 297/329 |
| 6,032,976 | * | 3/2000 | Dickie et al. | 280/650 |

FOREIGN PATENT DOCUMENTS 2 158 350 11/1985 (GB) .

OTHER PUBLICATIONS

Invacare Corporation, Action Tarsys Product Brochure, 1997.

* cited by examiner

*Primary Examiner*—Kevin Hurley
(74) *Attorney, Agent, or Firm*—MacMillan, Sobanski & Todd, LLC

(57) ABSTRACT

A tilt system for tilting a power wheelchair seat comprises a seat frame having laterally extending front and rear cross tubes and side tubes. A rear cross plate extends laterally between the wheelchair side frames and is slidably engageable with the side frames. A pivotal connection is provided between the rear seat cross tube and the rear cross plate. A front actuator cross tube is supported at a front end of the wheelchair base. A linear actuator is supported between the rear cross plate and the front actuator cross tube. A tilt linkage is disposed along opposite sides of the seat frame. Each tilt linkage has a front end pivotally connected to the wheelchair base and a rear end pivotally connected one of the side tubes of the seat frame. Another embodiment of the invention includes a glide system is secured to the inner surfaces of the wheelchair side frames. Another embodiment of the invention includes a wheelchair having a base comprises of two side frames. A glide system attached to the inside surface of each side frame. Another embodiment of the invention includes an adjustable pivot boss that is attachable to the side frames of a wheelchair so as to extend substantially perpendicularly from the side frames. A tilt linkage sleeve is pivotally engageable with the pivot boss. Both the pivot boss and the tilt linkage sleeve have co-axial central axes. The pivot boss is rotatably adjustable so as to change the location of axes.

5 Claims, 6 Drawing Sheets

TILT SYSTEM FOR A POWERED WHEELCHAIR SEAT

TECHNICAL FIELD

This invention relates in general to wheelchairs and, in particular, to motorized or powered wheelchairs. More particularly, this invention pertains to a tilt system for a powered wheelchair seat.

BACKGROUND OF THE INVENTION

Wheelchair occupants who remain in a fixed position for prolonged periods of time encounter trauma to the skin tissue or pressure sores. This trauma is a result of a constant pressure applied to the wheelchair occupant's person. The pelvis area or region of the wheelchair occupant is especially susceptible because the bones in the pelvis region are substantially sharp. Continuous pressure of the wheelchair seat cushion against the wheelchair occupant induced by the wheelchair occupant's weight pinches the skin in the pelvis region between the seat cushion and the bones in the pelvis region. The continuous pressure and the substantially sharp bones make the skin in the pelvis area highly prone to trauma.

To reduce the risk of trauma to the skin, the wheelchair occupant's body may be shifted periodically. This changes the weight distribution of the wheelchair occupant, which, in turn, changes the points of pressure against the wheelchair occupant's person. Wheelchair occupants, however, are often disadvantaged in that they do not have the ability to shift their own weight because of their immobility. To meet the needs of the wheelchair occupants, tilt systems have been devised to tilt the wheelchair seat, and thereby shift the weight of the wheelchair occupant.

Early wheelchair seat tilt systems were manually operated requiring the aid of one or more attendants to assist the wheelchair occupant in tilting the wheelchair seat. This did not satisfy the needs of the wheelchair occupant to the extent that the wheelchair occupant still required assistance to tilt the wheelchair seat.

More recent innovations in wheelchair seat tilt systems have led to automated tilt systems. Automated tilt systems generally include a wheelchair seat frame that is pivotally supported by a wheelchair base. The base typically includes a pair of spaced apart side frames. The wheelchair seat spans between the side frames. The wheelchair seat is generally provided with a rear laterally extending cross tube. The cross tube has opposing ends. These opposing ends pivotally engage the spaced apart side frames. The seat frame further includes side tubes and a front cross tube. The front and rear cross tubes and the side tubes are triangulated to form a rigid seat frame. Most conventional seat frames include a clevis on the front of the base frame and a clevis on the front of the seat frame for receiving opposing ends of a linear actuator. The actuator is extended and contracted by a motor. Contracting the actuator causes the front end of the seat frame to rise upwards, and extending the actuator causes the seat frame to lower back down.

This arrangement was originally problematic in that the actuator provided the sole support for the front end of wheelchair seat. This was not the most stable environment for the wheelchair occupant. To overcome this instability, braces were provided to support, or to provide supplemental support, for the wheelchair seat. The braces most often appear on opposing sides of the seat frame. The braces usually have a lower end pivotally attached to the wheelchair base and an upper end pivotally attached to the seat frame.

Until the more recent past, a common problem that remained in wheelchair tilt systems was associated with the center of gravity of the wheelchair occupant. Most tilt systems employed a fixed pivot axis upon which the wheelchair seat was tilted. As the wheelchair seat tilted back the wheelchair occupant's center of gravity shifted. This shift in the center of gravity was undesirable because it is most desirable to maintain the wheelchair occupant's center of gravity in an area over and between the front casters and the rear or drive wheels of the wheelchair. Distributing the wheelchair occupant's center of gravity in this area provides optimum control over the wheelchair and reduces the risk of the wheelchair's inadvertently tilting forwardly or rearwardly over. To meet this need, wheelchair seat frames have been mounted to the wheelchair base on a movable pivot that moves forward as the seat frame is tilted back. This maintains the wheelchair occupant's center of gravity in an area above and between the front caster and the drive wheels of the wheelchair. To facilitate the movement of the seat frame pivot points, an intermediate frame is employed. The intermediate frame is a bulky frame structure that is fixedly attached to the top of the wheelchair base. The intermediate frame has opposing side each of which embody a sliding pivot. The seat frame is coupled to the sliding pivot. As the seat frame is tilted back, the seat frame slides forward relative to the intermediate frame, shifting the wheelchair occupant's center of gravity forward to maintain the wheelchair occupant's center gravity between the front casters and the drive wheels of the wheelchair.

Although wheelchairs have made leaps in a direction to meet needs of the wheelchair occupants, improvements in wheelchairs have resulted in complicated and cumbersome configurations, such as, the intermediate frame structure used to accomplish the shift in the wheelchair occupant's center of gravity as the wheelchair seat frame tilts back. Conventional tilt systems are inefficient and expensive, in part, because of the complicated and cumbersome configurations. Costly tilt systems have provided little benefit to wheelchair occupants who struggle financially to meet their healthcare needs. What is needed is a more simplistic wheelchair seat tilt system that may be provided at a lower cost to the wheelchair occupant.

SUMMARY OF THE INVENTION

The present invention relates to a tilt system for tilting a power wheelchair seat. The tilt system comprises a seat frame having laterally extending front and rear cross tubes and side tubes. A rear cross plate extends laterally between the wheelchair side frames and is slidably engageable with the side frames. A pivotal connection is provided between the rear seat cross tube and the rear cross plate. A front actuator cross tube is supported at a front end of the wheelchair base. A linear actuator is supported between the rear cross plate and the front actuator cross tube. A tilt linkage is disposed along opposite sides of the seat frame. Each tilt linkage has a front end pivotally connected to the wheelchair base and a rear end pivotally connected to one of the side tubes of the seat frame.

Another embodiment of the invention includes a glide system that is secured to the inner surfaces of the wheelchair side frames.

Another embodiment of the invention includes a wheelchair that has a base comprised of two side frames. A glide system is attached to the inside surface of each side frame.

Another embodiment of the invention includes an adjustable pivot boss that is attachable to the side frames of a wheelchair so as to extend substantially perpendicularly from the side frames. A tilt linkage sleeve is pivotally engageable with the pivot boss. Both the pivot boss and the tilt linkage sleeve have co-axial central axes. The pivot boss is rotatably adjustable so as to change the location of axes.

Various objects and advantages of this invention will become apparent to those skilled in the art from the following detailed description of the preferred embodiment, when read in light of the accompanying drawings.

DETAILED DESCRIPTION OF THE INVENTION

Figure 1:
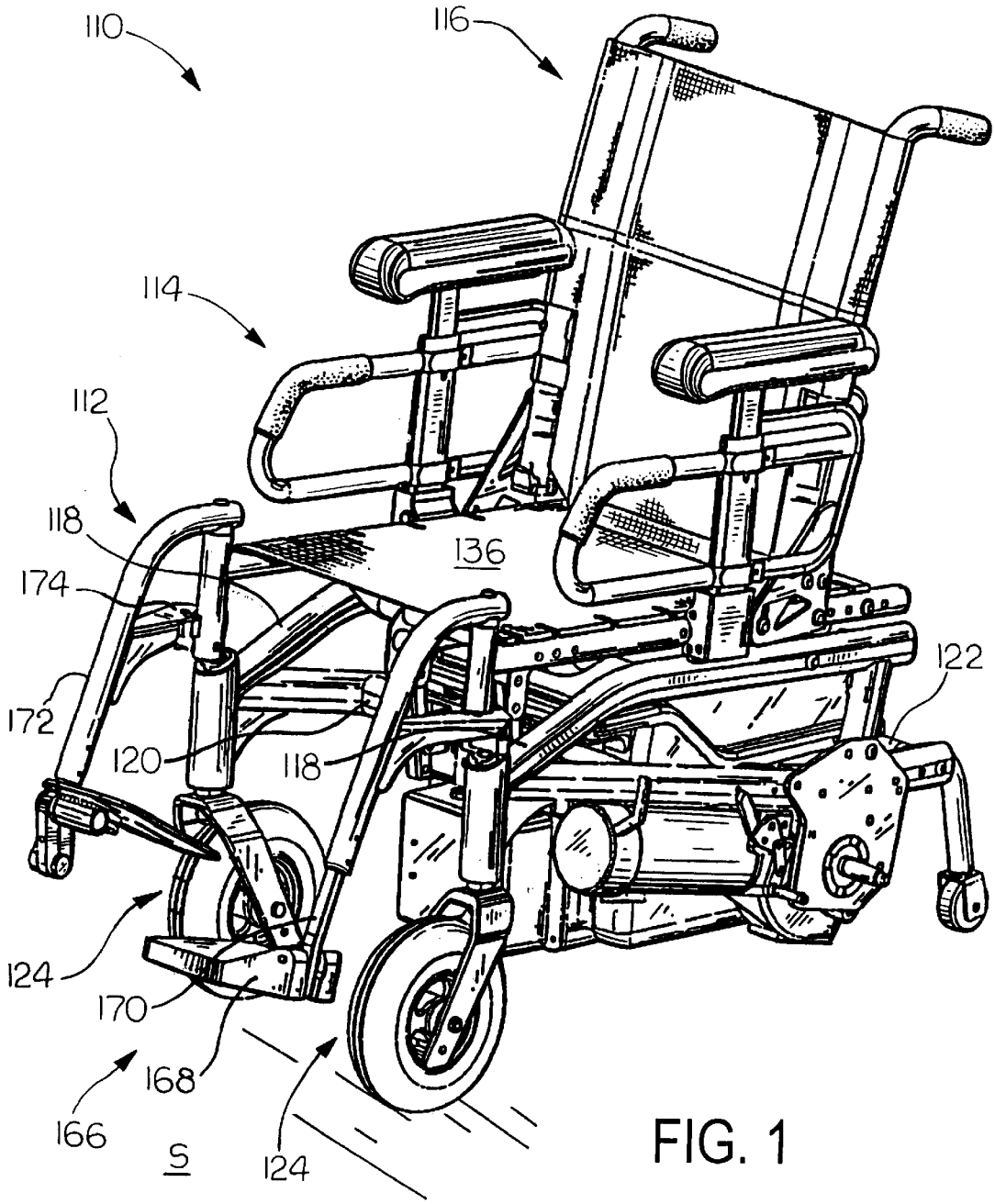
FIG. 1 is a front perspective view of a motorized wheelchair having a wheelchair seat tilt system according to the invention.
Figure 2:
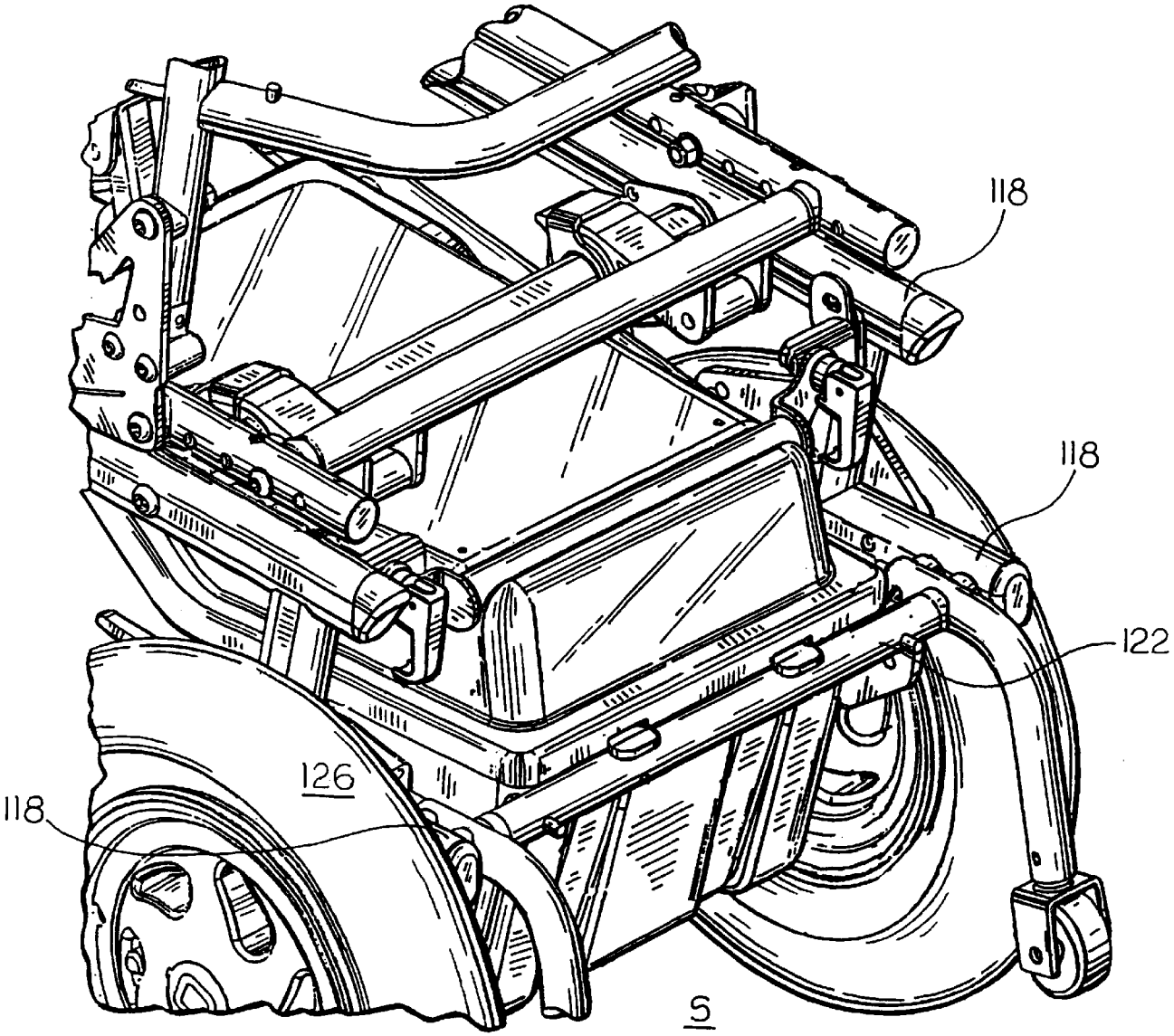
FIG. 2 is an enlarged rear perspective view of the wheelchair and wheelchair seat tilt system shown in FIG. 1.

There is illustrated in FIGS. 1 and 2 a wheelchair 110 comprising a base 112 and a seat frame 114 and backrest 116 supported by the base 112. The base 112 comprises a pair of side frames 118 and lateral struts or cross tubes 120 and 122 spanning 10 between and connecting the side frames 118. A pair of front caster/fork assemblies 124 supports a front portion of the wheelchair 110 on a supporting surface S. As illustrated in FIG. 2, a pair of rear/drive wheels 126 supports a rear portion of the wheelchair 110 on the supporting surface S. The wheelchair 110 is driven by the rear wheels 126 and is maneuvered by differentially driving the rear wheels 126. Independent motors differentially drive the rear wheels 126.

Figure 3:
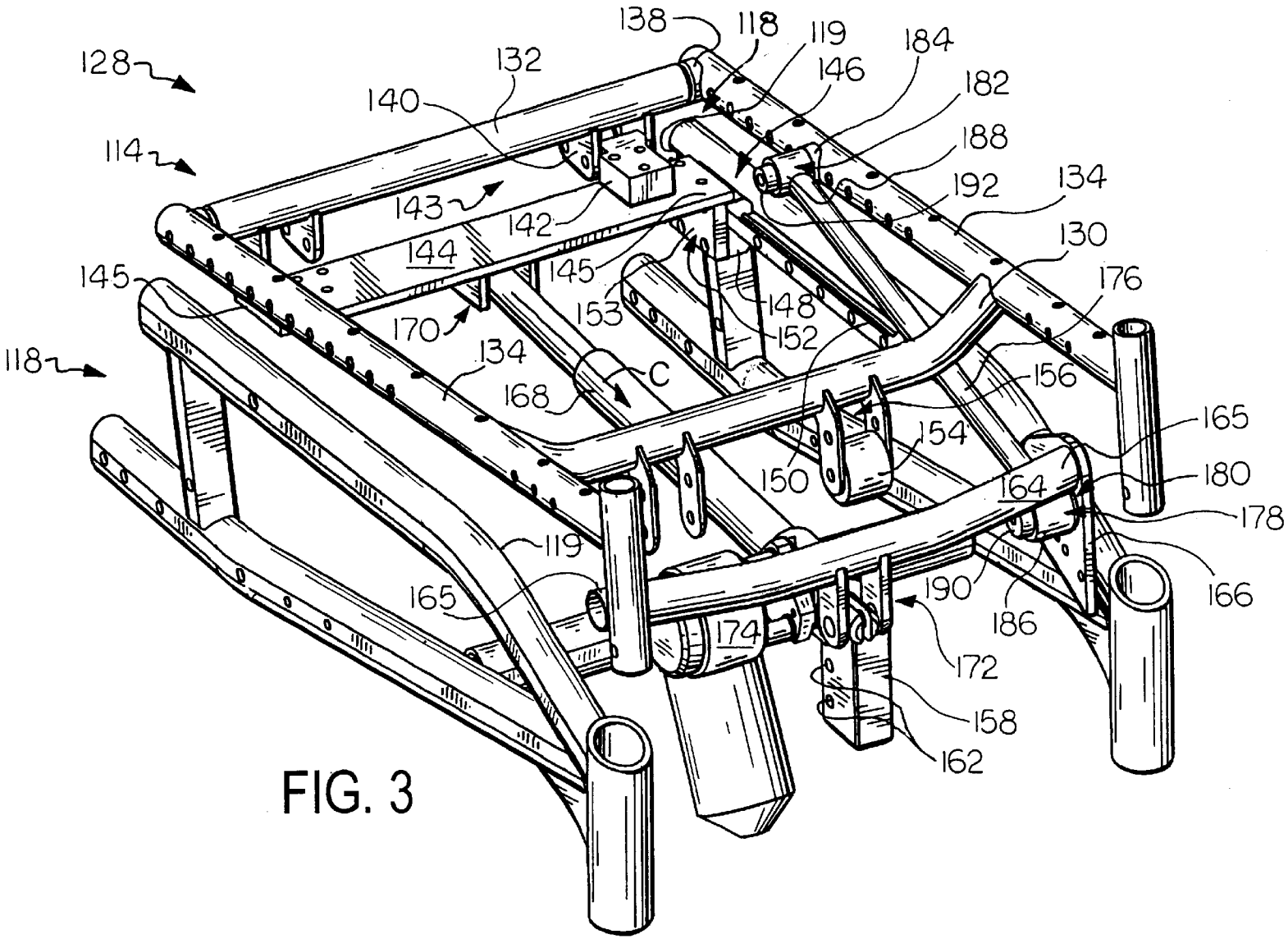
FIG. 3 is an enlarged partial perspective view of the wheelchair and wheelchair seat tilt system shown in FIG. 1.

The present invention, as shown in FIG. 3, includes a wheelchair seat tilt system, generally indicated at 128. It should be understood that right side of the wheelchair seat tilt system 128 is constructed as a mirror image of the left side. However, to simplify this description, only the left side of the wheelchair seat tilt 20 system 128 is shown. The wheelchair seat tilt system 128 includes a seat frame 114 comprising a laterally extending front seat cross tube 130 and a laterally extending rear seat cross tube 132. The front and rear seat cross tubes 130 and 132 span between two longitudinally extending seat side tubes 134. The front and rear seat cross tubes 130 and 132 and the seat side tubes 134 are triangulated to form the substantially rigid 25 seat frame 114 shown. A seat sling 136 (shown in FIG. 1) spans between the seat side tubes 134. Opposing sides of the seat sling 136 are attached to the seat side tubes 134 to support the seat sling 136 between the seat side tubes 134. The seat side tube 134 is provided to support a seat cushion (not shown).

Continuing with reference to FIG. 3, there is illustrated a rear boss 138 30 extending inward substantially perpendicularly from the seat side tube 134. The rear seat cross tube 132 extends between the seat side tubes 134 and has opposite ends which are attached to the rear bosses 138.

A clevis 140 is disposed at each one of the ends of the rear seat cross tube 132. A pivot block 142 is engageable with each clevis 140. Although not shown, the pivot block 142 in part forms a sleeve that may be arranged to co-align with holes in the clevis 140. A hinge pin (also not shown) passes through the holes in the clevis 140 and the sleeve to pivotally couple the clevis 140 and the sleeve together to form a hinge or pivotal connection, generally indicated at 143. This pivotal connection 143 is provided to allow the seat frame 114 to pivot, as will become apparent in the description that follows.

Alternatively, the connection between the rear seat cross tube 132 and the rear boss 138 may be a pivotal connection upon which the seat frame 114 may pivot and the connection 143 may be a rigid connection which rigidly couples the rear seat cross tube 132 to a laterally extending rear plate weldment or cross plate 144, which will be described the detail in the description that follows.

A front end of each pivot block 142 is coupled or attached to the cross plate 144 proximate opposing ends 145 of the rear cross plate 144. The pivot block 142 may be provided with a plurality of holes. The holes are preferably dimensioned to receive countersunk flathead cap screws (not shown). The holes in the pivot block 142 may be arranged to co-align with holes (not shown) in the rear cross plate 144. The countersunk flathead cap screws may be passed through the co-aligning holes and threadably engageable with nuts (not shown) below the rear cross plate 144 to attach the pivot block 142 to the rear cross plate 144.

The opposing ends 145 of the rear cross plate 144 are also provided with holes for receiving fasteners (not shown) for coupling or attaching the rear cross plate 144 to a glide system 146. The glide system 146 comprises a glide carriage 148 and a glide rail 150, which will be described in greater detail in the description that follows. The glide carriage 148 is attached the rear cross plate 144 through the aid of a back plate 152. The top of the back plate 152 is preferably provided with a plurality of threaded holes (not shown). These holes may be arranged to co-align with the holes in the opposing ends 145 of the rear cross plate 144. Threaded fasteners (not shown) are insertable into the holes in the opposing ends 145 of the rear cross plate 144 and threadably engageable with the holes in the top of the back plate 152. The fasteners may be tightened to secure the back plate 152 substantially perpendicularly to the opposing ends 145 of the rear cross plate 144.

The back plate 152, in turn, is attached to the glide carriage 148. As shown in the drawings, a plurality of holes are provided in the face 153 of the back plate 152. The holes are preferably dimensioned to receive countersunk flathead cap screws (not shown). The holes in the back plate 152 may be arranged to co-align with threaded holes (not shown) in the back of the glide carriage 148. The countersunk flathead cap screws may be passed through the holes in the back plate 152 and threadably engageable with the threaded holes in the glide carriage 148 to attach the back plate 152 to the glide carriage 148. Although the back plate 152 shown is attached to the glide carriage 148, it should be understood that the back plate 152 may be an integral part of the glide carriage 148.

The glide carriage 148 is slidably engageable with a glide rail 150. A glide rail 150 is mounted to the inside surface 119 of each side frames 118. The glide carriage 148 and the glide rail 150 cooperate to form a linear guide. A linear guide suitable for carrying out the invention is the Accuglide® Linear Guide #3 (Miniature Series) manufactured by Thomson Industries, Bay City, Mich., U.S.A. The glide rail 150 is provided with a plurality of holes. The inside surface 119 of each side frame 118 is provided with a track. Most preferably, the side frames 118 are extruded and the track is formed in the side frames 118. The track is in the shape of a dovetail. A dovetail block (not shown) is slidably engageable with the track. A plurality of holes (not shown) in the dovetail block may be arranged to co-align with the holes in the glide rail 150. Threaded fasteners (also not shown) are insertable through the holes in the track and are threadably engageable with the threaded holes in the dovetail block. The fasteners may be tightened until the glide rails 150 are tightly secured to the inside surface 119 of the side frames 118.

The glide system 146, although slidably displaceable, supports the rear cross plate 144 relative to the side frames 118. The rear cross plate 144, in turn, supports the rear seat cross tube 132. The rear seat cross tube 132 supports the rear end of the seat frame 114.

A bumper 154 supports the front of the seat frame 114. The bumper 154 shown is in the form of a ring or doughnut formed from a material such as rubber or urethane. The bumper 154 is supported by the front seat cross tube 130. More particularly, the bumper 154 is supported by a front clevis 156 that extends generally downward from the front seat cross tube 130. The front clevis 156 is provided with a pair of co-aligning holes. In particular, the front clevis 156 is defined by two spaced apart tabs. A hole passes through each tab. The holes through the two tabs co-align with one another to form the pair of co-aligning holes in the front clevis 156.

A hole (not shown) is likewise provided in the bumper 154. The hole extends laterally through the bumper 154. The bumper 154 is received by the front clevis front clevis 156, that is, the bumper 154 is received between the tabs forming the front clevis 156. The hole in the bumper 154 is arranged so that the hole in the bumper 154 co-aligns with the pair of co-aligning holes in the front clevis 156. A fastener or pin (not shown) is insertable through the co-aligning holes to affix the bumper 154 to the front clevis 156.

Figure 4:
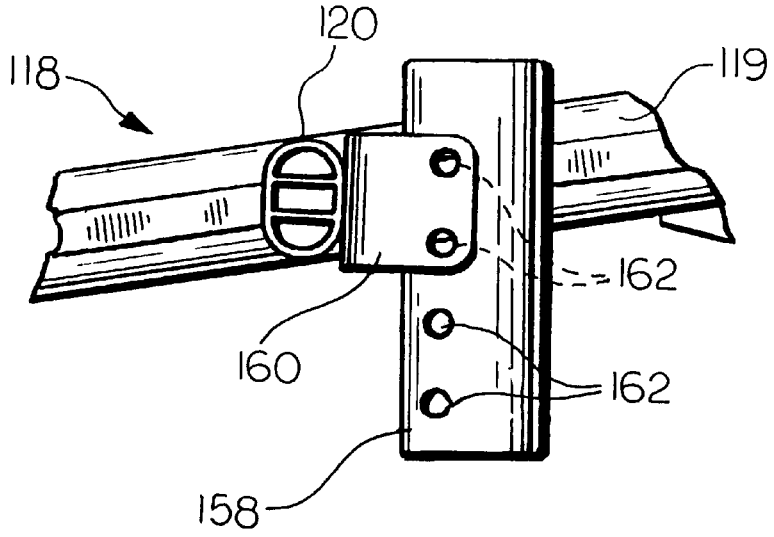
FIG. 4 is an enlarged partial side elevational view of a wheelchair side frame and a clevis supporting a tilt stop block for use with the invention.

The bumper 154 is engageable with a tilt stop block 158. The tilt stop block 158 is supported by a clevis 160 that extends forwardly from the cross tube 120 at the front end of the base 112. The tilt stop block 158 extends upwardly from the clevis 160, as shown more clearly in FIG. 4. Two spaced apart tabs define the clevis 160. A hole passes through each tab to form a pair of co-aligning holes in the clevis 160.

The tilt stop block 158 is provided with a plurality of vertically spaced apart holes 162. More particularly, the tilt stop block 158 is comprised of a substantially square sleeve. The vertically spaced apart holes pass through opposing sides of the sleeve. Holes through the opposing sides of the hollow sleeve co-align with one another to form a plurality of vertically spaced apart co-aligning holes 162 in the tilt stop block 158.

The tilt stop block 158 is insertable into the clevis 160. The tilt stop block 158 may be arranged so that the holes in the clevis 160 selectively co-align with one set or pair of the vertically spaced apart co-aligning holes 162 in the tilt stop block 158. A fastener or pin is insertable through the holes in the clevis 160 and the co-aligning holes 162 in the tilt stop block 158.

By co-aligning the uppermost holes 162 in the tilt stop block 158 with the holes in the clevis 156, the elevation of the bumper 154 is minimized. By co-aligning the lower holes 162 in the tilt stop block 158 with the holes in the clevis 160, the elevation of the bumper 154 is adjusted to a maximum elevation. The elevation of the bumper 154 may be adjusted to engage the bottom of the front seat cross tube 130 when the seat frame 114 is at an initial tilt position.

The wheelchair seat tilt system 128 further comprises a front actuator cross tube 164 supported at the front of the wheelchair base 112. In particular, the wheelchair seat tilt system 128 extends laterally between the side frame 118 at the front of the wheelchair 110. The front actuator cross tube 164 has opposing ends 165. Opposing mounting plates 166 are supported or attached substantially perpendicularly to the opposing ends 165 of the front actuator cross tube 164. A linear arrangement of holes is provided in the opposing mounting plates 166. A dovetail block (not shown) is slidably inserted in the track in the inside surface 119 of each side frame 118 towards the front end of the side frame 118. Similar to the dovetail blocks describe above, this dovetail is provided with a plurality of threaded holes. The opposing mounting plates 166 may be arranged so that the linear arrangement of holes provided in the opposing mounting plates 166 co-aligns with the threaded holes in the dovetail block. A threaded fastener (not shown) is insertable through the linear arrangement of holes in the opposing mounting plates 166 and threadably engageable with the threaded holes in the dovetail block. The fastener is tightened until the opposing mounting plates 166 are tightly secured to the inside surface 119 of each side frame 118.

A linear actuator 168 is supported between the rear cross plate 144 and the front actuator cross tube 164. A motor 174 drives the linear actuator 168. An example of a linear actuator suitable for carrying out the invention is a model LA30 manufactured by Linak of Guderup, Denmark, Nordborg.

The rear end of the linear actuator 168 is engageable with a rear clevis 170 defined by two laterally spaced apart tabs extending downwardly from the rear cross plate 144. A hole (not shown) is provided in each tab. The holes in the tabs co-align with one another. The rear end of the linear actuator 168 is likewise provided with a hole (not shown). The rear end of the linear actuator 168 is positionable between the tabs so that the holes in the rear end of the linear actuator 168 co-align with the holes in the tabs. A fastener or pin (not shown) is insertable through the co-aligning holes to pivotally couple or attach the linear actuator 168 to the rear clevis 170.

The front end of the linear actuator 168 is also engageable with a clevis 172. This clevis 172 is defined by two laterally spaced apart tabs extending downwardly from the front actuator cross tube 164. A hole (not shown) is provided in each tab. The holes in the tabs co-align with one another. A hole (not shown) is also provided in the front end of the linear actuator 168. The front end of the linear actuator 168 may be arranged between the tabs extending from the front actuator cross tube 164 so that the holes in the front end of the linear actuator 168 co-align with the holes in the tabs. A fastener or pin (not shown) is insertable through the co-aligning holes to pivotally couple or attach the linear actuator 168 to the clevis 172.

The linear actuator 168, although permitted to extend and contract, remains in a substantially fixed position relative to the side frames 118. As is clearly shown, the linear actuator 168 is centrally located laterally between the side frames 118. The linear actuator 168 extends longitudinally. Since the elevation of the rear cross plate 144 and the opposing mounting plates 166 remains substantially constant relative to the side frames 118, the elevation of the linear actuator 168 remains substantially constant relative to the side frames 118. Moreover, since the devises 170 and 172 are fixed relative to the rear cross plate 144 and the opposing mounting plates 166, respectively, the linear actuator 168 remains in a fixed lateral position relative to the side frames 118 as well. Note that linear actuator 168 shown is arranged to remain in a substantially horizontal plane, even throughout the operation of the wheelchair seat tilt system 128, that is, even throughout the tilting of the seat frame 114. Although the above described arrangement of the linear actuator 168 is preferred, other arrangements may suitable.

The front end of the seat frame 114 is urged upward by tilt linkages 176 as the seat frame 114 pivots on the pivotal connection 143. The tilt linkages 176 are disposed generally longitudinally along opposite sides of the seat frame 114. Each tilt linkage 176 has a front end 178 pivotally connected to a front pivot boss 180 and a rear end 182 pivotally connected to a rear pivot boss 184. A front pivot boss 180 extends inwardly from each opposing mounting plates 166. A rear pivot boss 184 extends inwardly from an inner rear surface of each seat side tube 134.

The front and rear ends 178 and 182 of each tilt linkage 176 include a sleeve 186 and 188, respectively. The front sleeve 186 is pivotally engageable with the front pivot boss 180 and the rear sleeve 188 is pivotally engageable with the rear pivot boss 184. An anti-friction sleeve, such as a nylon sleeve, may be interposed between the sleeves 186 and 188 and the pivot bosses 180 and 184. The face or end of each pivot boss 180 and 184 is preferably provided with a threaded portion (not shown). A front cap 190 is threadably engageable with the front pivot boss 180 to retain the front sleeve 186 on the front pivot boss 180. Similarly, a rear cap 192 is threadably engageable with the rear pivot boss 184 to retain the rear sleeve 188 on the rear pivot boss 184. The caps 190 and 192 prevent the sleeves 186 and 188 from sliding axially off the pivot bosses 180 and 184.

Figure 5:
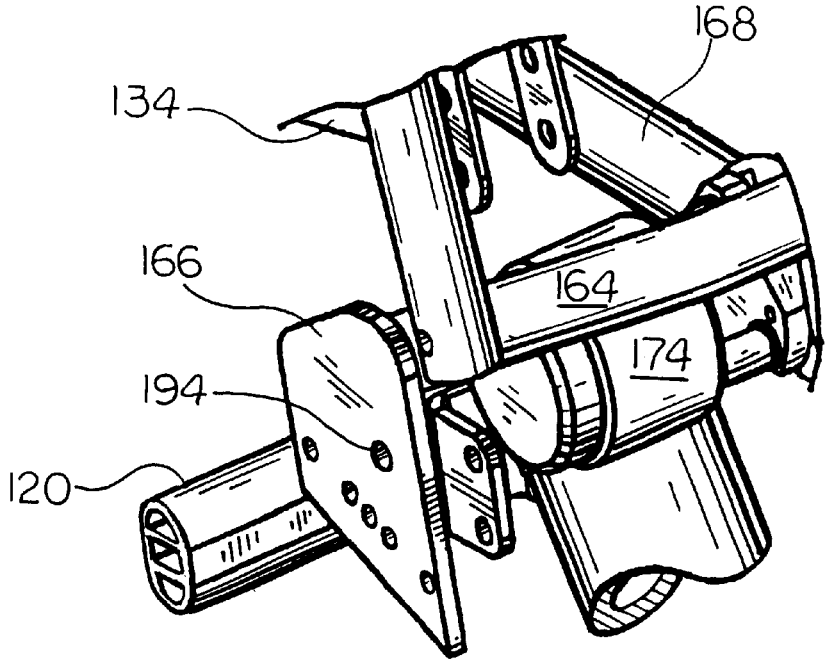
FIG. 5 is an enlarged partial front perspective view of the wheelchair base and the wheelchair seat tilt system of the invention, and further showing a threaded hole in a mounting plate for fastening a pivot boss to the mounting plate.

The front pivot boss 180 is distinguished from the rear pivot boss 184 as follows. A front pivot boss 180 is movably attachable to each opposing mounting plate 166. The rear pivot boss 184 is preferably fixedly attached to the seat side frame 134. A manner in which the front pivot bosses 180 may be movably attached is through the use of threaded fasteners 198 (shown in FIGS. 6 through 8). Each opposing mounting plates 166 may be provided with a threaded hole 194, as shown in FIG. 5. The front pivot bosses 180 are each provided with a passage or bore 196. The threaded fasteners 198 may be inserted through the bore 196 in each one of the front pivot bosses 180 and further threadably engaged with the threaded hole 194 in of the opposing mounting plates 166. The threaded fastener 198 may be tightened to tightly secure the front pivot boss 180 to an inner surface of each one of the opposing mounting plates 166.

Figure 6:
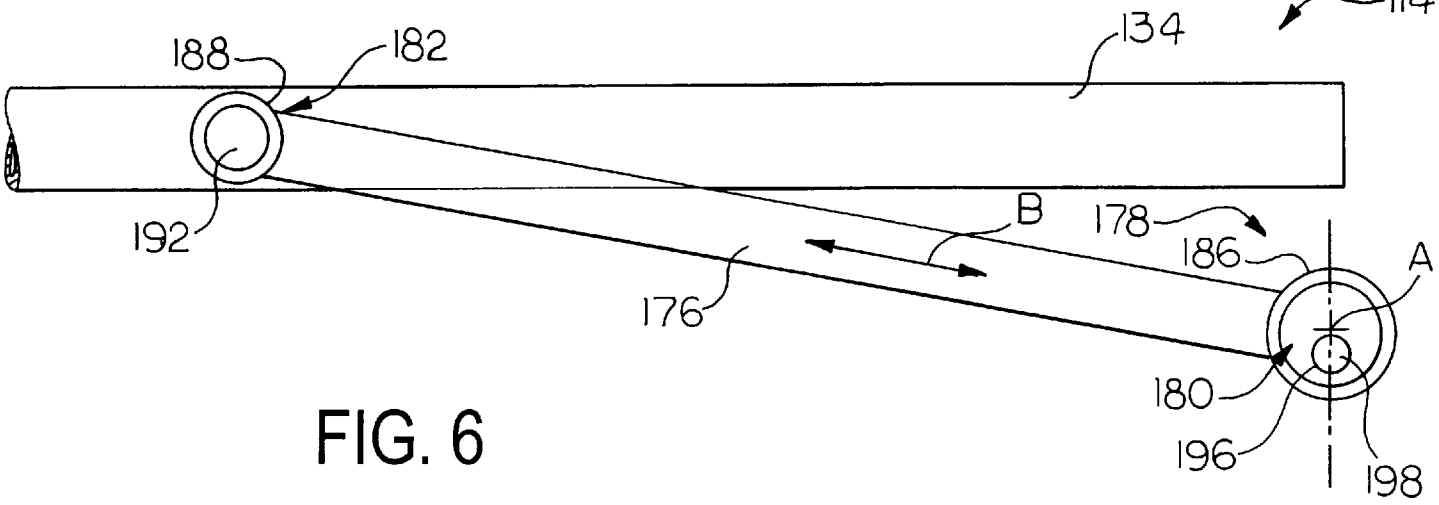
FIG. 6 is a schematic representation in elevation of the seat frame and the tilt linkage of the invention in a first position.
Figure 7:
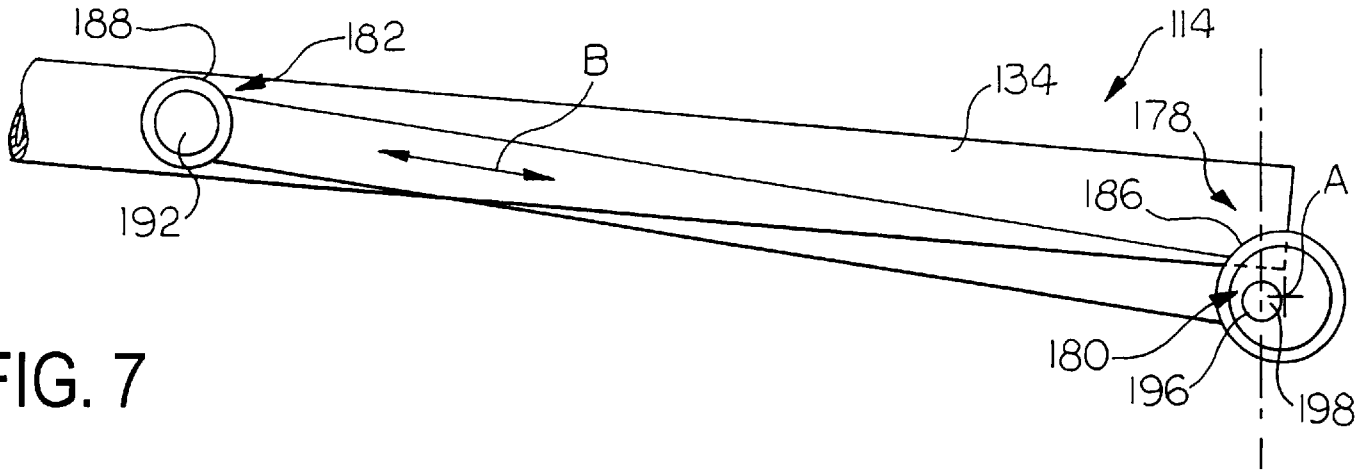
FIG. 7 is a schematic representation in elevation of the seat frame and the tilt linkage of the invention in a second position.
Figure 8:
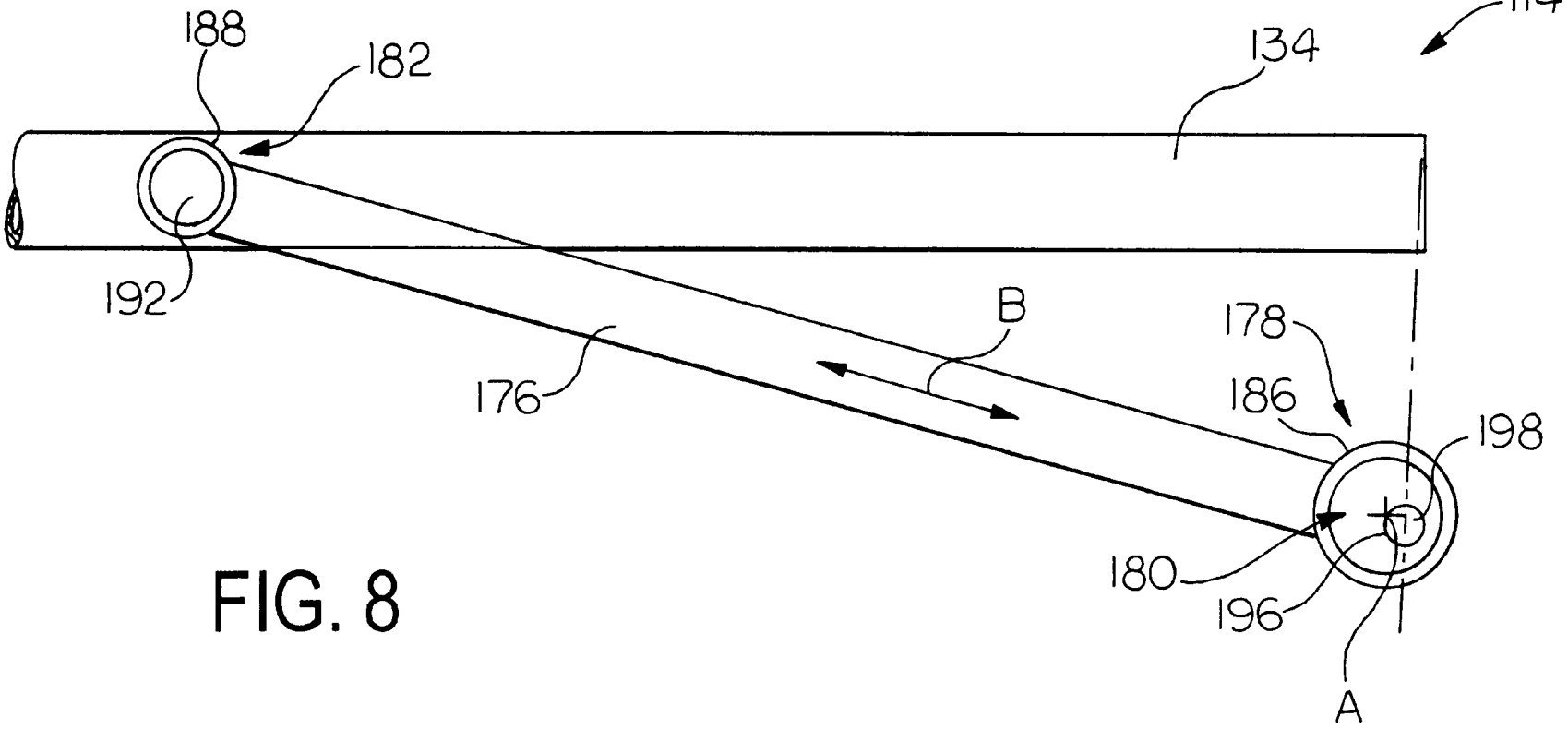
FIG. 8 is a schematic representation in elevation of the seat frame and the tilt linkage of the invention in a third position.

As shown in FIGS. 6 through 8, each front pivot boss 180 is rotatably adjustable about the threaded fastener 198. This is accomplished by loosening the threaded fasteners 198 enough to free the front pivot bosses 180 to enable the front pivot bosses 180 to turn, such as to the various positions shown in the drawings. Once the front pivot bosses 180 are turned to a desired position, the threaded fasteners 198 may be tightened once again to tightly secure the front pivot bosses 180 to the opposing mounting plates 166.

Each front pivot boss 180 is rotatably adjustable to change the initial tilt of the seat frame 114. The phrase "initial tilt" refers to the position of the seat frame 114 with the linear actuator 168 fully extended. It may be desirable for the seat frame 114 to be oriented at some angle other than zero when the linear actuator 168 is fully extended. It should be noted that the bore 196 in each front pivot boss 180 is an eccentric bore. Rotating the bore 196 changes the location of the axis A through the front pivot boss 180. This, in turn, changes the position of the axis A of the front sleeve 186 that is concentric or co-axial with the axis A of the front pivot boss 180. Changing the location of this axis A causes each tilt linkage 176 to shift along a line co-axial with the axis of the tilt linkage 176, or along the line B. As noted in FIGS. 4 through 6, the rotation of the front pivot bosses 180 effects a displacement of the front sleeve 186 which, in turn, causes the inclination of the seat frame 114 to change.

In operation, the wheelchair seat tilt system 128 permits the seat frame 114 to be tilted relative to the base 112. The seat frame 114 may be tilted from an initial position, which may be an initial tilt position, such as the position shown in FIG. 6, to a desired tilted position and returned to the initial position. For example, when the linear actuator 168 is fully extended the seat frame 114 is in an initial position. In this initial position, it is most desirable that the seat frame 114 make no more than a slight contact with the bumper 154. As the motor 174 is operated to contract the linear actuator 168 along the line C, as shown in FIG. 3, the seat frame 114 slides forward on the glide rails 150. As the seat frame 114 slides forward, the tilt linkages 176 urge the front end of the seat frame 114 upward, tilting the seat frame 114 on the pivotal connection 143. It should be understood that as the seat frame 114 slides forward on the glide rails 150, the wheelchair occupant's center of gravity remains substantially in an area over and between the fork assembly 124 and the drive wheel 126.

As is clearly shown, a single linear actuator 168 is used to effect movement of the back plate 152. The movement of the back plate 152 pulls the seat frame 114 forward while tilting the seat frame 114 back. The back plate 152 translates, or distributes the displacement effected by the linear actuator 168, to the spaced apart pivotal connections 143. The glide systems 146 on the opposing sides of the seat frame 114 retain the back plate 152 in a substantially lateral disposition, reducing the risk of the back plate's 152 twisting and binding throughout the operation of the wheelchair seat tilt system 128.

By rotatably adjusting the front pivot boss 180, the initial tilt of the seat frame 114 may be adjusted. Once a desired initial tilt of the seat frame 114 is selected, the front pivot bosses 180 are tightly secured to the opposing mounting plates 166. Obviously, an adjustment in the initial tilt of the seat frame 114 effects the cooperation between the seat frame 114 and the bumper 154. The front pivot boss 180 and the tilt stop block 158 may both be adjusted to achieve the most suitable cooperation between the seat frame 114 and the bumper 154.

Ultimately, the most suitable cooperation between the seat frame 114 and the bumper 154 is achieved when the seat frame 114 makes a slight contact with the bumper 154 when the linear actuator 168 is fully extended. The motor 174 becomes inoperative upon a full extension of the linear actuator 168. If the seat frame 114 make significant contact with the bumper 154 prior to the linear actuator's 168 being fully extended, the load on the motor 174 increases, resulting in undue stress on the motor 174. The combined adjustability of the front pivot boss 180 and the tilt stop block 158 reduces the risk of undue stress on the motor 174 by allowing only a slight contact to be achieved between the seat frame 114 and the bumper 154 upon fully extending the linear actuator 168. Also the elimination of excess or wasted travel of the linear actuator 168 reduces power requirements, thereby extending the charge life of the wheelchair battery (not shown).

Is should be understood that the terms "front", "forward", "rear", "vertical", and "horizontal" are orientation terms as related to the wheelchair 110 shown in FIG. 1 and described in the "BRIEF DESCRIPTION OF THE DRAWINGS."

Although the rear cross plate 144 shown is substantially rectangular and planar in construction, the rear cross plate 144 may take on other structural configurations which are not shown but are within the scope of the invention. Moreover, the pivotal connection 143 shown is illustrative of a pivotal connection that may be used in the invention. Other pivotal connections may be employed.

It should be further understood that the various fastening arrangements, such as the engagement of the threaded fasteners shown, are for illustrative purposes and that other fastening arrangements may be suitable for carrying out the invention.

Although a single linear actuator 168 is shown, a plurality of linear actuators may be employed. However, a greater number of linear actuators would result in a more complicated, less cost-effective configuration. Although the front clevis 156 and the tilt stop block 158 are preferred embodiments, other structural configurations may fall within the spirit of the invention.

The glide system 146 shown is for illustrative purposes. It should be understood that other glide systems may be employed. Moreover, the attachment of the glide system 146 is for illustrative purposes. A feature of the invention, however, is the use of a glide system attached to the inside surface 119 of the side frames 118, instead of being attached to the top of the side frames 118. This permits the elevation of the seat frame 114 to be maintained when a tilting seat frame is desired. The manner in which the glide system 146 is attached also eliminates the need for an intermediate frame, and thus, is simplistic and cost-effective.

The principle and mode of operation of this invention have been described in its preferred embodiment. However, it should be noted that this invention may be practiced otherwise than as specifically illustrated and described without departing from the scope of the invention.

What is claimed is:

1. A wheelchair comprising:

a side frame;

a seat tilt linkage having a sleeve with a central axis; and a pivot boss having a central axis, said pivot boss being attached relative to said wheelchair side frame so as to extend from the wheelchair side frame, said pivot boss pivotally engaging said tilt linkage sleeve in such a manner that the central axis of said pivot boss is co-axial with the central axis of said tilt linkage sleeve, said pivot boss further being rotatably adjustable so as to change the location of the axes.

2. A wheelchair seat tilt system for tilting the seat frame of a wheelchair, the wheelchair having a base comprising side frames, said wheelchair seat tilt system comprising:

a pair of front pivot bosses each having a central axis, each said front pivot boss being attached to one of the wheelchair side frames so as to extend substantially perpendicularly from the wheelchair side frames;

a rear pivot boss attached to opposing sides of the wheelchair seat frame so as to extend substantially perpendicularly from the opposing sides of the wheelchair seat frame; and a tilt linkage having a front sleeve and a rear sleeve, said front sleeve being pivotally engageable with said front pivot boss and said rear sleeve being pivotally engageable with said rear pivot boss, said front sleeve having a central axis that is coaxial with the axis of one of said front pivot bosses, said front pivot boss being rotatably adjustable so as to change the location of the axes.

3. The pivot boss according to claim 2, wherein said front pivot boss has an eccentric bore, said front pivot boss being adapted to be attached to the wheelchair side frame by a fastener passing through said eccentric bore.

4. A wheelchair comprising:

a side frame;

a seat tilt linkage having a sleeve with a central axis; and a pivot boss having a central axis, said pivot boss being attached relative to said wheelchair side frame, said pivot boss pivotally engaging said tilt linkage sleeve in such a manner that the central axis of said pivot boss is co-axial with the central axis of said tilt linkage sleeve, said pivot boss further being rotatably adjustable so as to change the location of the axes, wherein said pivot boss has an eccentric bore, said pivot boss being adapted to be attached to said wheelchair side frame by a fastener passing through said eccentric bore.

5. A tilt system for connecting the side tube of a seat frame to the side frame of a base frame of a wheelchair, the tilt system comprising:

a front pivot boss having a central axis and an eccentric bore, said front pivot boss being adapted to be attached to the wheelchair side frame by a fastener passing through said eccentric bore;

a rear pivot boss attached to the wheelchair seat frame; and a linkage having a front sleeve and a rear sleeve, said front sleeve being pivotally engageable with said front pivot boss and said rear sleeve being pivotally engageable with said rear pivot boss, said front sleeve having a central axis that is coaxial with the central axis of said front pivot boss, said front pivot boss being rotatably adjustable so as to change the location of the central axes relative to the eccentric bore.

* * * * *